US011358681B2

(12) United States Patent
Becke et al.

(10) Patent No.: US 11,358,681 B2
(45) Date of Patent: Jun. 14, 2022

(54) WEATHER GUARD FOR A POWER BOAT

(71) Applicants: Alan E. Becke, Greensboro, MD (US); Jesse A. Becke, Greensboro, MD (US)

(72) Inventors: Alan E. Becke, Greensboro, MD (US); Jesse A. Becke, Greensboro, MD (US)

( * ) Notice: Subject to any disclaimer, the term of this patent is extended or adjusted under 35 U.S.C. 154(b) by 0 days.

(21) Appl. No.: 16/936,035

(22) Filed: Jul. 22, 2020

(65) Prior Publication Data

US 2021/0024176 A1 Jan. 28, 2021

Related U.S. Application Data

(60) Provisional application No. 62/876,844, filed on Jul. 22, 2019.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC .... B63B 17/00; B63B 17/02; B63B 2017/026
USPC ..... 114/361
See application file for complete search history.

(56) References Cited

U.S. PATENT DOCUMENTS 5,121,703 A * 6/1992 Smith ..... B63B 19/02 114/361
2007/0044699 A1* 3/2007 Van Woodham ..... B63B 19/00 114/71

* cited by examiner

*Primary Examiner* — Lars A Olson
(74) *Attorney, Agent, or Firm* — Laubscher & Laubscher, P.C.

(57) ABSTRACT

A rigid weather guard for a center console of a power boat includes a rapidly deployable protective shield. The shield has a top edge, a bottom edge, a first side edge that is pivotably connectable with a portion of the boat, and a second side edge that is configured for connection with a gunwale of the power boat. The pivotable connection of the first side edge provides movement between an open and closed position. When in the open position, the second side edge is connected with the gunwale securing the shield in place to block adverse weather. Preferably, the protective shield has a transparent portion.

11 Claims, 5 Drawing Sheets

WEATHER GUARD FOR A POWER BOAT

This application claims the benefit of U.S. provisional patent application No. 62/876,844 filed Jul. 22, 2019.

BACKGROUND OF THE DISCLOSURE

The present disclosure relates generally to a weather protection apparatus for a power boat, and more specifically to a weather guard for a center console of power boat.

Many commercial and recreational power boats are open-air boats that do not include a roof, either as a portion or as the entirety of the boat. Such boats come equipped with, or can be modified to include, weather protective devices to shield individuals from adverse marine conditions.

Windshields are one example of such a device found on many open-air power boats. These are typically made of clear acrylic or glass and are often mounted to the forward face of the boat helm console. Often, a tubular superstructure which straddles the console is employed to which the windshield is mounted. This structure can also carry a hard top or T-top which provides shade to the helm console as well as protection from precipitation. T-tops are made of a suitable material such as fiberglass or canvas stretched across an upper structure.

In some cases, flexible clear plastic sewn into fabric panels and affixed in place using snaps or zippers are employed to increase the area of protection provided by this combination of top, windshield, and console. These panels have limited utility as they are inherently slow to deploy and must be stored on board when not in use, taking up valuable space. Moreover, marine canvas shrinks, resulting in a fit that becomes tighter over time, and ultimately will result in failure of the snaps and zippers due to stress. Torn canvas is another problem associated with these protective devices.

Beyond the issues with deploying these devices and their wear over time, most configurations do not offer full protection from the deck to the underside of the top structure, nor do they offer full protection across the beam of the vessel. They are not rapidly deployable nor are they stowable. When they are stowed, they require storage in a portion of the boat and can incur damage from scratches, mold, and mildew, and the like.

One example of a weather shield that can be incorporated with a boat is disclosed in the Rundquist U.S. Pat. No. 2,308,209, which discloses a collapsible wind-spray shield having front and side walls that are attachable to the front of a boat. The walls are foldable and collapsible for easy use and storage. The shield includes two front walls with windows and two, triangular side walls. The shield is extendable across the width of the boat from side-edge to side-edge. The outer edges of the triangular side-walls have a hook and spring for connecting the shield to the boat and providing tension to keep the shield in place.

The Tucker et al. U.S. Patent Application Publication No. 2006/0124045 discloses a temporary canopy system for providing shelter to people on a boat. The system includes a Bimini frame and a canopy having a top panel, two side panels and a rear panel, as shown in FIGS. 3-5. The top panel is connected to the Bimini frame and the side and rear panels are zippered to the top panel. The side and rear panels cover the width of the boat and can include windows.

Though the above devices have their advantages, they also have drawbacks as previously discussed. Accordingly, there is a need for a rapidly deployable shroud or shield assembly which provides full protection to the helm and its surrounding positions, which extends from the deck up to the underside of the top, and across the entire width of the cockpit, and which can be deployed and stowed rapidly.

SUMMARY OF THE DISCLOSURE

Accordingly, it is an object of the present disclosure to provide a rigid weather guard for a center console of a power boat which includes a rapidly deployable protective shield. The shield has a top edge, a bottom edge, a first side edge that is pivotably connectable with a portion of the boat, and a second side edge that is configured for connection with a gunwale of the power boat. The pivotable connection of the first side edge provides movement between open and closed positions. When in the open position, the second side edge is connected with the gunwale securing the shield in place to block adverse weather. Preferably, the protective shield has a transparent portion.

In one embodiment, the first side edge includes a hinge assembly that connects the shield with the power boat, and the second side edge includes a connection assembly for connecting the shield with the boat gunwale.

In another embodiment, the protective shield includes an upper portion that has a greater width than a lower portion. In this instance, when the protective shield is connected with the power boat and pivoted to its open position, the upper portion extends across the boat gunwale.

It is also an object of the present disclosure to provide a weather guard for a center console of a power boat. The weather guard includes a frame configured for connection with the center console and a pair of protective shields as described above that are pivotably connected with the frame.

In one embodiment, the weather guard also includes a windshield that is attached to the frame. The windshield has top, bottom and side edges, and either the top or bottom edge is pivotably connected with the frame for vertical movement of the windshield about a horizontal pivot axis between first and second positions.

In another embodiment, the frame includes a pair of opposing side walls configured for connection with the center console. In this instance, the protective shields are pivotably connected with the opposing side walls.

BRIEF DESCRIPTION OF THE FIGURES

Other objects and advantages of the disclosure will become apparent from a study of the following specification when viewed in the light of the accompanying drawing, in which.

DETAILED DESCRIPTION

The present disclosure relates to a weather guard for a center console power boat that can be rapidly deployed to provide protection to boat occupants when adverse weather occurs. Unlike with many known protective devices in the art, the presently disclosed weather guard includes a rigid shield, which provides a device that can be quickly arranged in place and that can withstand severe weather.

Figure 1:
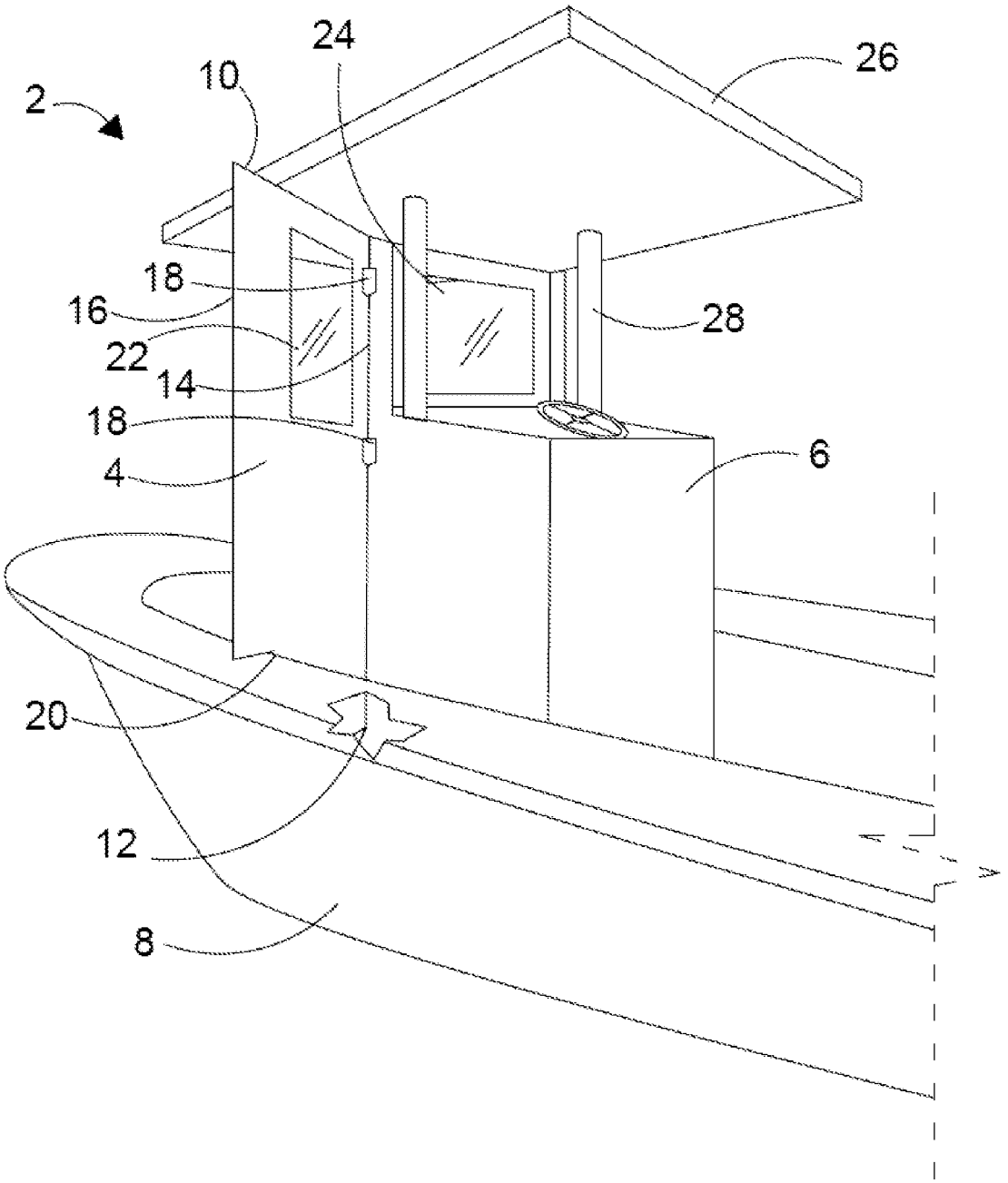
FIG. 1 is a perspective view of a first embodiment of a weather guard connected with a power boat according to the present disclosure.
Figure 2:
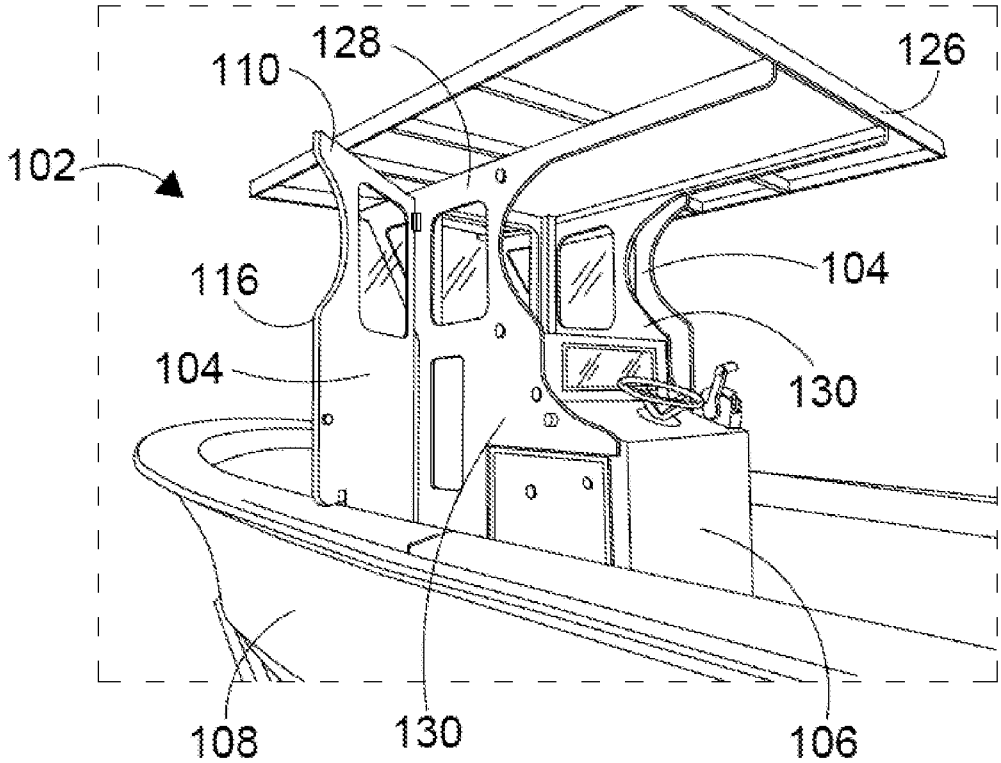
FIGS. 2-4 are perspective views of a second embodiment of a weather guard according to the present disclosure.
Figure 3:
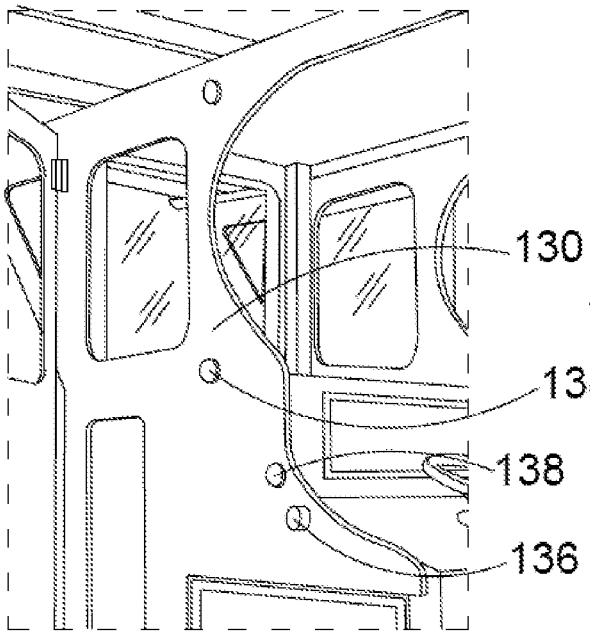
Figure 4:
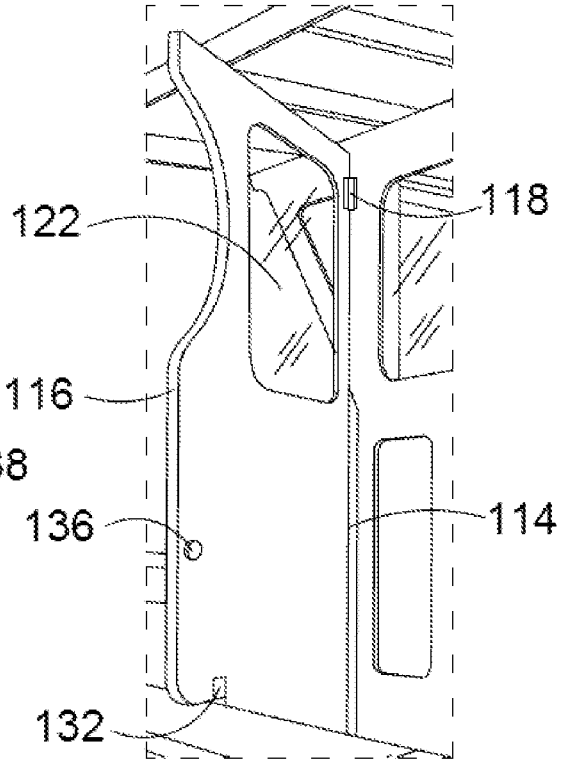

A first embodiment of the weather guard 2 is shown in FIG. 1 and includes a protective shield 4 pivotably connected with the center console 6 of a boat 8. The shield has a top edge 10, bottom edge 12, first side edge 14 and second side edge 16. There are two hinge assemblies 18 connecting the first side edge with the center console for pivotable movement between open and closed positions. In FIG. 1, the shield is in its open position.

When in the open position, the second side edge 16 of the shield contacts the boat gunwale 20, blocking the entirety of the port side of the boat which in turn prevents adverse weather from reaching occupants behind the shield 4. The shield preferably contains a window 22 which allows boat occupants to view conditions in front of the boat when the shield is in its open position. In addition to the protective shield, the weather guard 2 includes a windshield 24 and T-top 26 connected to a frame 28.

As shown in FIG. 1, the second side edge 16 of the shield 4 is configured to extend across the gunwale 20 and secured to the gunwale to provide further protection to occupants behind the shield and added stability to the shield. Though FIG. 1 shows a single protective shield connected with one side of a center console, it will be understood by those with skill in the art that a shield can be connected to both sides of the center console to provide protection to both the port and starboard sides of the boat. Further, it will be understood that the shield could be pivotably connected to another portion of the boat, for instance the frame 28.

Referring now to FIGS. 2-9, a second embodiment of the weather guard 102 is shown. In this embodiment, a frame 128 configured for connection with the center console 106 of the boat 108 is provided, and a pair of protective shields 104 are pivotably connected with the frame via hinge assemblies 118. As with the embodiment in FIG. 1, each of the protective shields has a top edge 110, a bottom edge 112, a first side edge 114, a second side edge 116, and a window 122.

The frame has two side walls 130 to which the protective shields 104 connect. The first side edge 114 of each shield is pivotably connected with its respective side wall, rather than directly with the boat. Each protective shield includes a lock assembly 132 for securing the shield with a boat gunwale 120, and a connection device 136 for securing the shield with the side walls 130 when the shield is in its closed position. The frame side walls include rubber stoppers 138 against which each protective shield rests when in its closed position. In addition to the protective shields, the weather guard includes a T-top 126 and a windshield 124, both of which are connected with the frame 128.

Figure 5:
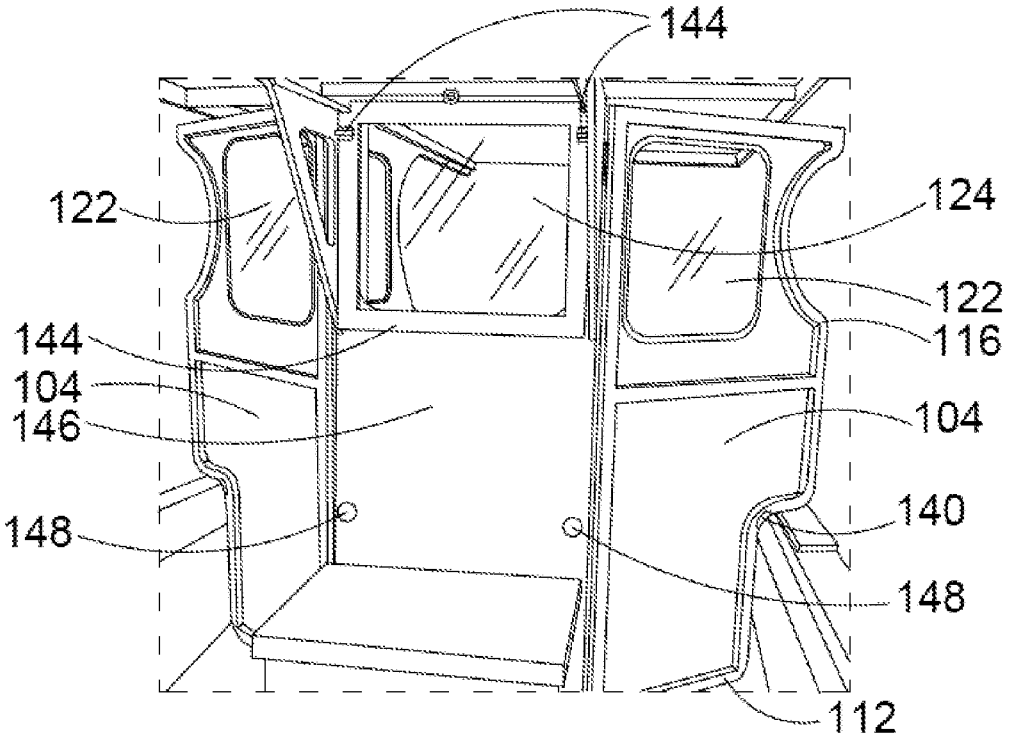
FIG. 5 is a front perspective view of the weather guard of FIGS. 2-4 with both protective shields in their open position.
Figure 6:
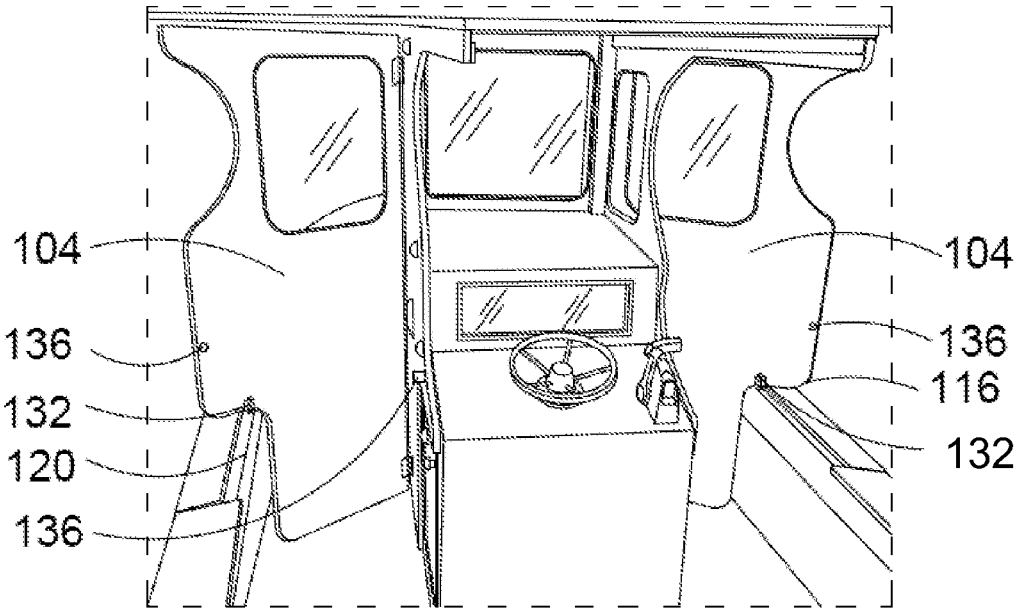
FIG. 6 is a rear perspective view of the weather guard shown in FIG. 5.

FIGS. 5 and 6 show the protective shields 104 in their open position and the windshield 124 in a generally upright position, providing complete protection from the deck to the T-top and across the beam of the boat 108. In addition to the second side edge lock assembly 132, the protective shields 104 include a rubber flap 140 connected with the second outer edge 116 of each protective shield at an interface between the side edge 116 and gunwale 120 to protect the gunwale and protective shield from wear and tear. The side edge lock assembly provides additional a secure connection of the protective shield with the gunwale.

As shown in FIGS. 5 and 6, the windshield 124 includes two lock assemblies 142 for securing upper side edges of the windshield with the frame 128 when the windshield is in its upright position. The lower edge of the windshield includes a hinge assembly 144 for pivoting the windshield to its downward position when not in use. The wall 146 below the windshield includes two rubber stoppers 148 against which the windshield rests when in its downward position.

Figure 7:
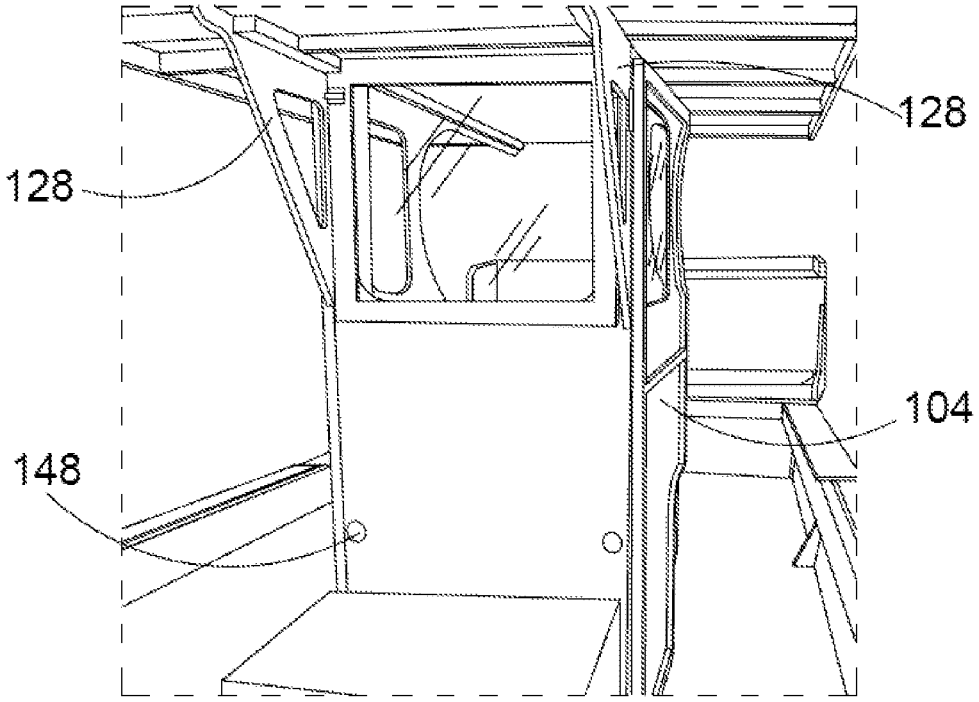
FIG. 7 is a front perspective view of the embodiment of FIGS. 2-6 with the protective shields in their closed position.
Figure 8:
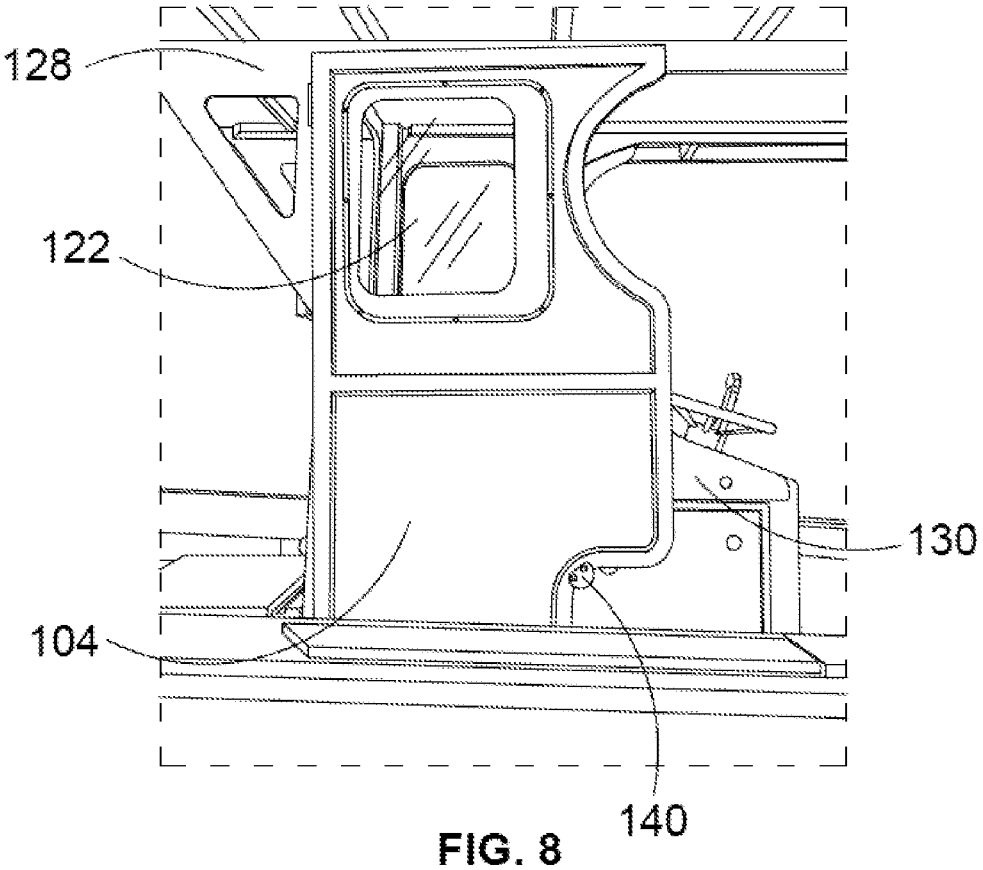
FIG. 8 is a side view of the weather guard shown in FIG. 7.
Figure 9:
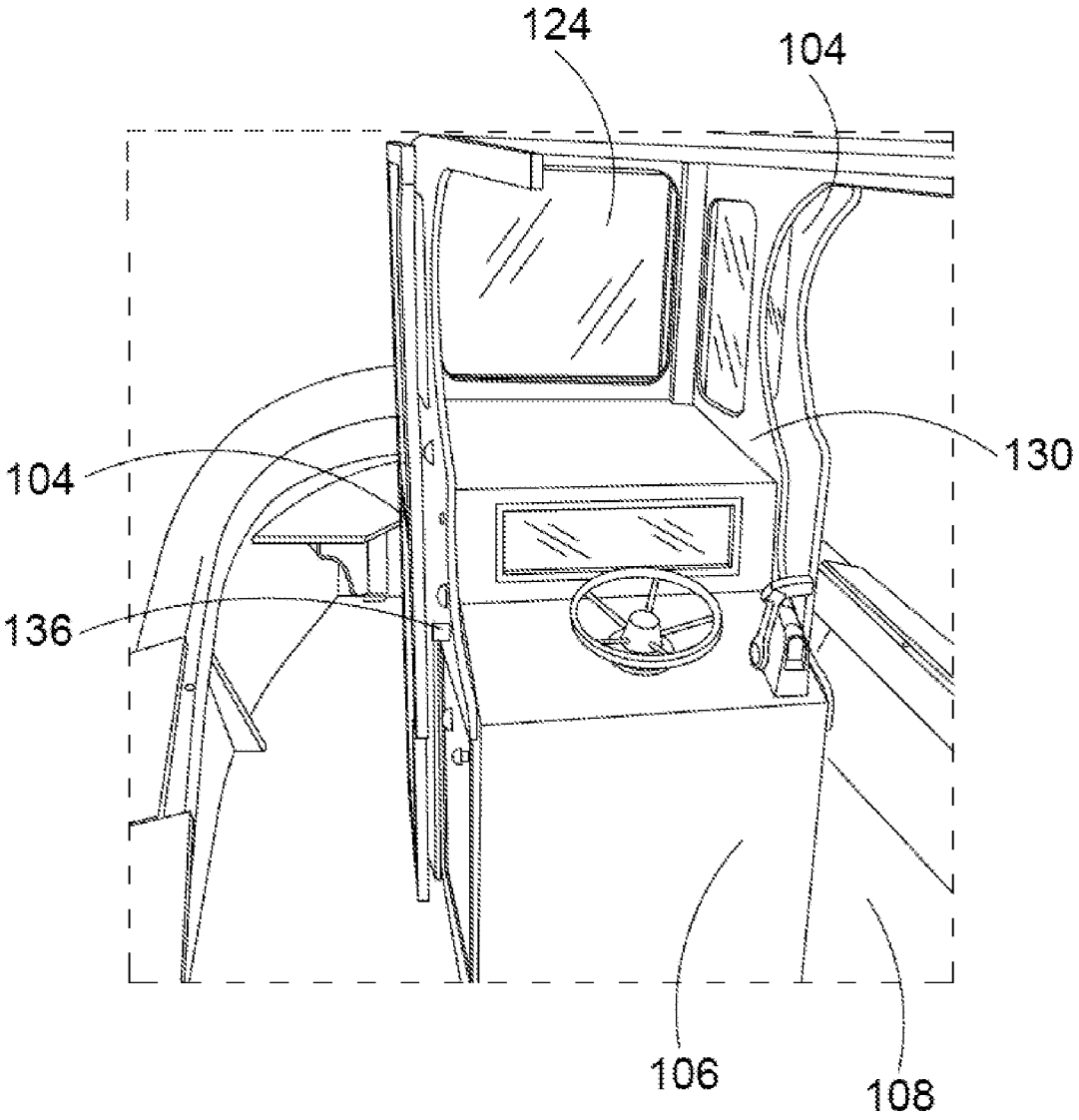
FIG. 9 is a rear perspective view of the weather guard shown in FIGS. 7 and 8.

Referring now to FIGS. 7-9, the weather guard 102 is shown with the protective shields 104 in their stowed state providing space for occupants to move about the boat. The stowed shields take up a minimal amount of space. The arrangement of the protective shields as described above and shown in FIGS. 7-9 results in a rapidly deployed weather guard that, in addition to the T-top and windshield, provides complete protection across the beam and from deck to T-top. The minimal space taken up by the protective shields and the quickness with which they can be deployed and stowed, provides two important improvements over known protective devices.

Although the above description references particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A rigid weather guard for a center console of a power boat, comprising a protective shield having a top edge, a bottom edge, a first side edge pivotably connectable with a portion of the boat for movement between open and closed positions, and a second side edge configured for connection with a gunwale of the power boat when said shield is in the open position, said protective shield including an upper portion having a greater width than a lower portion, whereby when said protective shield is connected with the power boat and pivots to its open position, said upper portion extends across a portion of the boat gunwale.

2. A rigid weather guard as defined in claim 1, wherein said first side edge includes a hinge assembly connecting said shield with the power boat.

3. A rigid weather guard as defined in claim 1, wherein said second side edge includes a connection assembly connecting said shield with the boat gunwale.

4. A rigid weather guard as defined in claim 1, wherein said protective shield has a transparent portion.

5. A rigid weather guard for a center console of a power boat, comprising:

(a) a frame configured for connection with the center console; and (b) a pair of protective shields connected with said frame each having a top edge, a bottom edge, a first side edge pivotably connectable with said frame for movement between open and closed positions, and a second side edge configured for connection with a gunwale of the power boat when said shield is in the open position, each said protective shield including an upper portion having a greater width than a lower portion, whereby when each said protective shield pivots to its open position, said upper portion extends across a portion of a respective boat gunwale.

6. A rigid weather guard as defined in claim 5, and further comprising a top wall connected with said frame.

7. A rigid weather guard as defined in claim 5, and further comprising a windshield having top, bottom and side edges, one of said top and bottom edges being pivotably connected with said frame for vertical movement between a first and second position.

8. A rigid weather guard as defined in claim 5, wherein said frame comprises a pair of opposing side walls configured for connection with the center console, each said protective shield pivotably connected with one of said opposing side walls.

9. A rigid weather guard as defined in claim 5, wherein said frame includes a pair of hinge assemblies for connecting said pair of protective shields with said frame.

10. A rigid weather guard as defined in claim 5, wherein said second side edge of each said protective shield includes a connection assembly connecting said shields with respective boat gunwales.

11. A rigid weather guard as defined in claim 5, wherein each said protective shield has a transparent portion.

* * * * *